US010823394B1

(12) United States Patent
Hsu

(10) Patent No.: US 10,823,394 B1
(45) Date of Patent: Nov. 3, 2020

(54) MOVABLE SOUND WALL LAMP ASSEMBLY

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Gaung-Dong (CN)

( * ) Notice: Subject to any disclaimer, the term of this patent is extended or adjusted under 35 U.S.C. 154(b) by 0 days.

(21) Appl. No.: 16/745,756

(22) Filed: Jan. 17, 2020

(51) Int. Cl.
*F21V 33/00* (2006.01)
*F21S 8/00* (2006.01)
*F21L 4/00* (2006.01)

(52) U.S. Cl.
CPC ..... *F21V 33/0056* (2013.01); *F21L 4/00* (2013.01); *F21S 8/033* (2013.01)

(58) Field of Classification Search
CPC ..... F21V 33/0056; F21S 8/033; F21L 4/00
See application file for complete search history.

(56) References Cited

U.S. PATENT DOCUMENTS

2009/0213598 A1* 8/2009 Terry ..... F21V 33/0024 362/419
2019/0203890 A1* 7/2019 Moore ..... F21L 4/08

* cited by examiner

*Primary Examiner* — Thomas M Sember
(74) *Attorney, Agent, or Firm* — Karin L. Williams; Mayer & Williams PC

(57) ABSTRACT

A wall lamp assembly includes a wall seat, and a wall lamp removably mounted on the wall seat. The wall lamp includes a housing, an acoustics device, a protective covering, a cover module, a primary lighting, a secondary lighting, and a charging battery. The charging battery is electrically connected with the acoustics device, the primary lighting, and the secondary lighting. The wall seat includes a wall washer, a drive power supply electrically connected with the wall washer, and a photosensitive device electrically connected with the wall washer. The drive power supply is electrically connected with the charging battery when the wall lamp is placed on the wall seat. Thus, when the wall lamp is removed from the wall seat, the wall lamp is used individually, thereby enhancing the versatility of the wall lamp assembly.

9 Claims, 3 Drawing Sheets

MOVABLE SOUND WALL LAMP ASSEMBLY

BACKGROUND OF THE INVENTION

1. Field of the Invention

The present invention relates to an illuminating apparatus and, more particularly, to a wall lamp assembly.

2. Description of the Related Art

A conventional wall lamp is mounted on the wall to provide an illuminating function. The conventional wall lamp usually has an outstanding appearance to provide a decorative function. However, the conventional wall lamp is affixed to the wall such that it cannot be removed from the wall and used individually, thereby limiting the versatility thereof.

BRIEF SUMMARY OF THE INVENTION

The primary objective of the present invention is to provide a movable sound wall lamp assembly having a mobile function.

In accordance with the present invention, there is provided a wall lamp assembly comprising a wall seat, and a wall lamp removably mounted on the wall seat. The wall lamp includes a housing, an acoustics device, a protective covering, a cover module, a primary lighting, a secondary lighting, and a charging battery. The acoustics device is mounted in the housing. The protective covering is mounted on the housing. The cover module is mounted on the protective covering. The primary lighting is mounted on a bottom of the cover module. The secondary lighting is mounted on the housing and extends into the protective covering. The charging battery is mounted in the housing. The charging battery is electrically connected with the acoustics device, the primary lighting, and the secondary lighting. The wall seat includes a wall washer, a drive power supply electrically connected with the wall washer, and a photosensitive device electrically connected with the wall washer. The drive power supply of the wall seat is electrically connected with the charging battery of the wall lamp when the wall lamp is placed on the wall seat.

According to the primary advantage of the present invention, when the wall lamp is removed from the wall seat, the wall lamp is used individually, thereby enhancing the versatility of the wall lamp assembly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
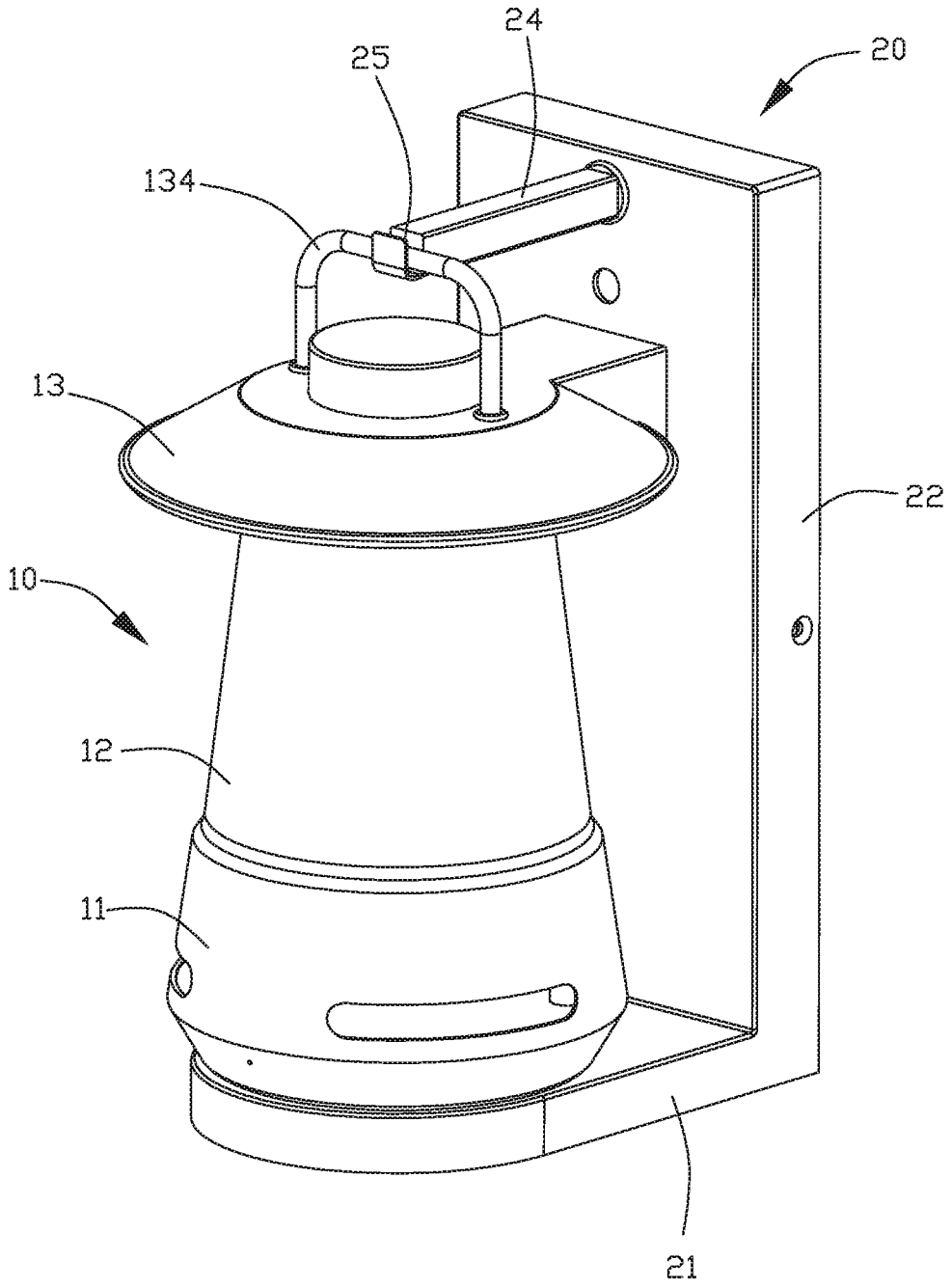
FIG. 1 is a perspective view of a wall lamp assembly in accordance with the preferred embodiment of the present invention.
Figure 2:
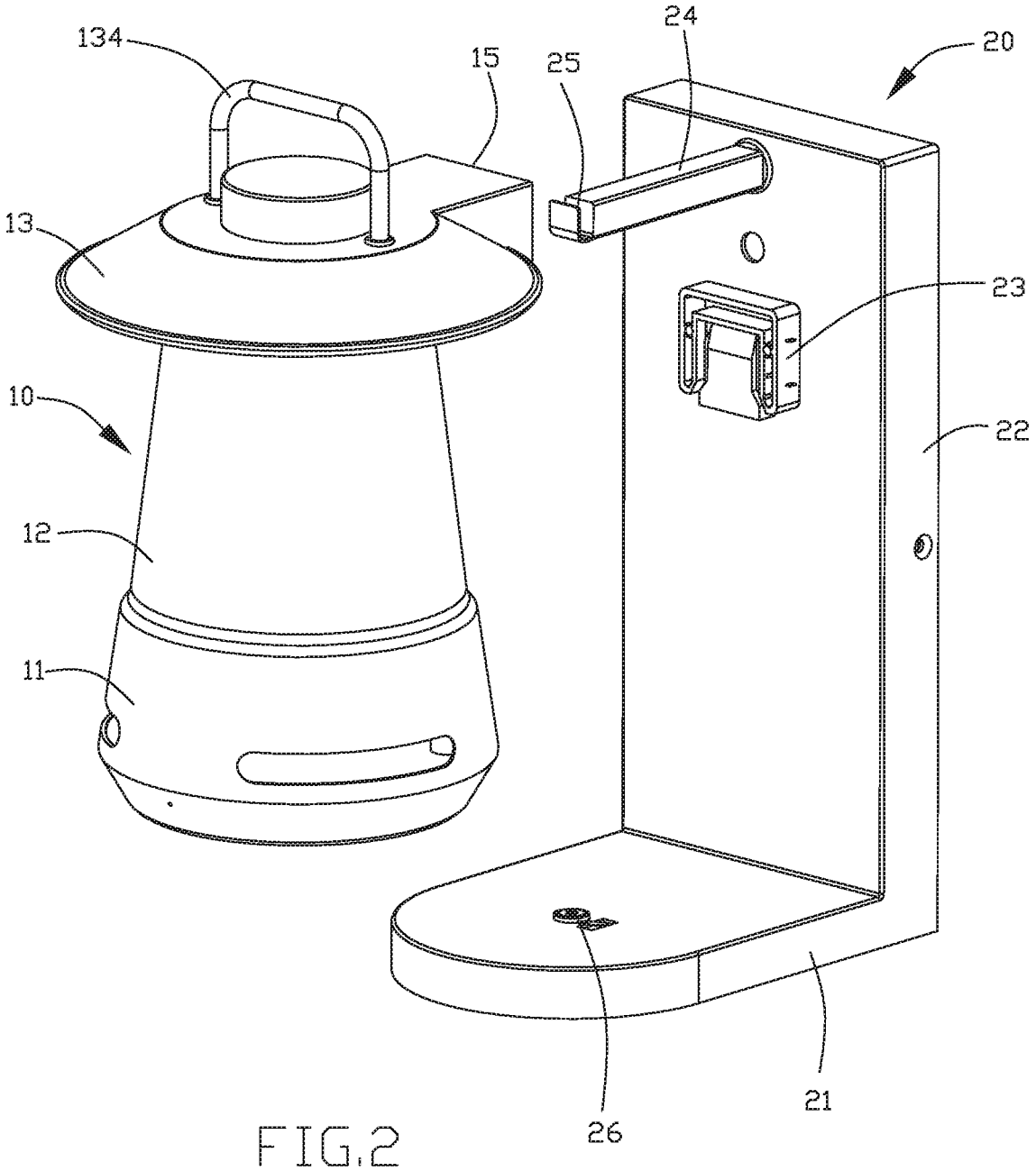
FIG. 2 is a schematic perspective view showing usage of the wall lamp assembly as shown in FIG. 1.
Figure 3:
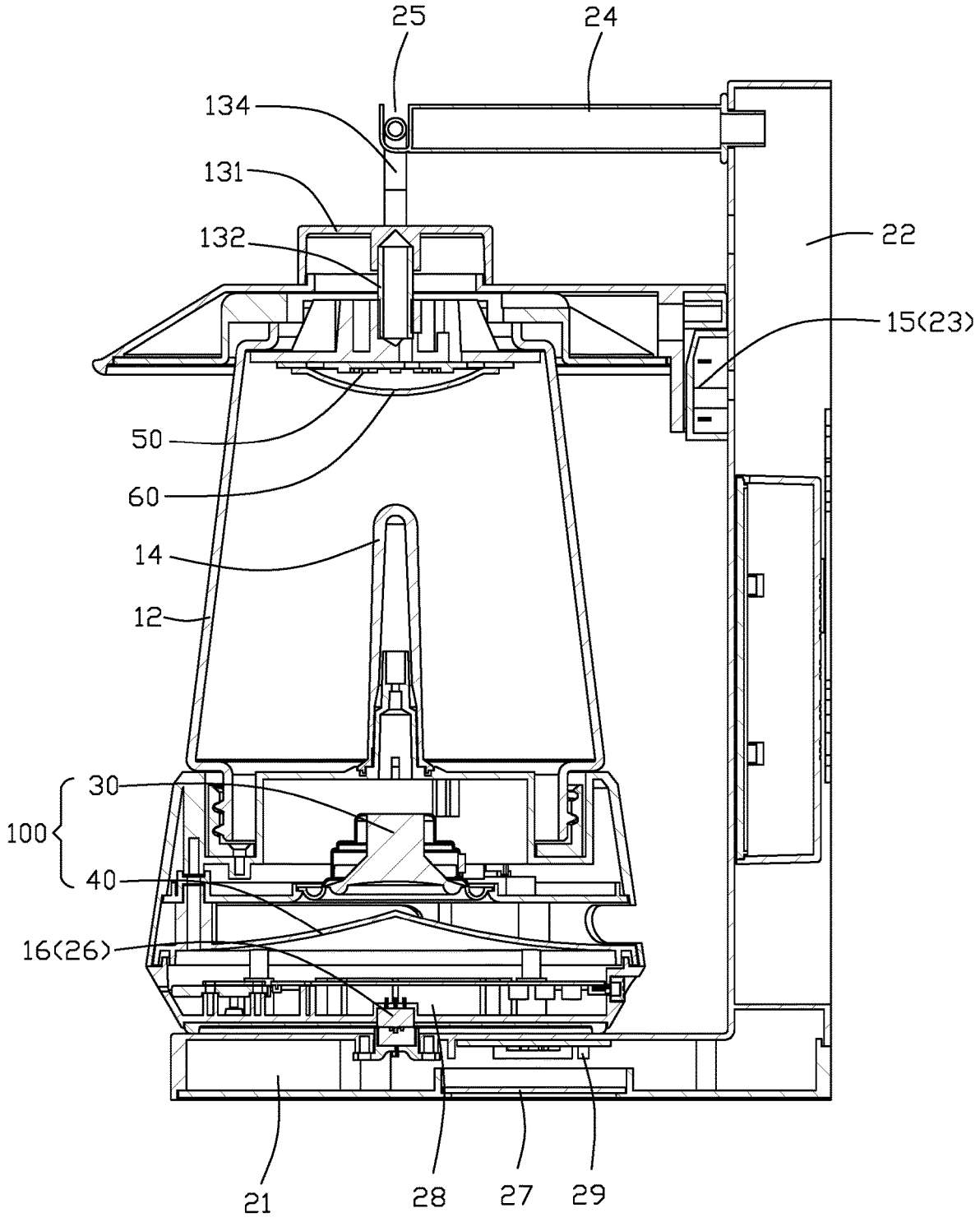
FIG. 3 is a cross-sectional view of the wall lamp assembly as shown in FIG. 1.

Referring to FIGS. 1-3, a wall lamp assembly in accordance with the preferred embodiment of the present invention comprises a wall seat 20, and a wall lamp 10 removably mounted on the wall seat 20.

The wall lamp 10 includes a housing 11, an acoustics device 100, a protective covering (or hood or shade or shroud) 12, a cover module 13, a primary lighting 50, a secondary lighting 14, and a charging battery 28. The acoustics device 100 is mounted in the housing 11. The protective covering 12 is mounted on the housing 11 by screwing. The cover module 13 is mounted on the protective covering 12. The primary lighting 50 is mounted on a bottom of the cover module 13. The secondary lighting 14 is mounted on the housing 11 and extends into the protective covering 12. The charging battery is mounted in the housing 11. The charging battery 28 is electrically connected with the acoustics device 100, the primary lighting 50, and the secondary lighting 14, and supplies an electric energy to the acoustics device 100, the primary lighting 50, and the secondary lighting 14.

The wall seat 20 includes a wall washer (or wall washer light) 27, a drive power supply electrically connected with the wall washer 27, and a photosensitive device (or an electric eye) 29 electrically connected with the wall washer 27. The drive power supply of the wall seat 20 is electrically connected with the charging battery 28 of the wall lamp 10 when the wall lamp 10 is placed on the wall seat 20. The photosensitive device 29 turns on the wall washer 27 under a dark condition, and turns off the wall washer 27 under a bright condition.

In the preferred embodiment of the present invention, the wall lamp 10 further includes a first connecting terminal 16 mounted on a bottom of the housing 11, and a second connecting terminal 15 mounted on a side of the cover module 13. The first connecting terminal 16 is electrically connected with the charging battery 28 to charge the charging battery 28. The second connecting terminal 15 is electrically connected with the charging battery 28 to charge the charging battery 28.

In the preferred embodiment of the present invention, the wall seat 20 has an L-shaped structure and includes a mounting plate 21, a connecting plate 22 connected with the mounting plate 21, a first quick charging terminal 26 mounted on the mounting plate 21, and a second quick charging terminal 23 mounted on the connecting plate 22. The wall washer 27 is mounted on a bottom of the mounting plate 21. Preferably, the connecting plate 22 and the mounting plate 21 are formed integrally.

In the preferred embodiment of the present invention, the cover module 13 includes a top cover 131 mounted on and covering an open top of the protective covering 12, a link 132 connected with the top cover 131, and a mounting member 133 connected with the link 132. The link 132 connects the top cover 131 and the mounting member 133, such that the mounting member 133 is connected with the top cover 131 through the link 132. The mounting member 133 is mounted in the protective covering 12.

In the preferred embodiment of the present invention, the primary lighting 50 includes a lighting body and a lampshade 60. The lampshade 60 is locked on a bottom of the mounting member 133. The lighting body is located between the mounting member 133 and the lampshade 60.

In the preferred embodiment of the present invention, the bottom of the mounting member 133 is provided with a plurality of locking holes. The lampshade 60 is provided with a plurality of protruding blocks extending upward. Each of the protruding blocks has a top provided with a locking piece extending downward slantingly. The protruding blocks extend through the locking holes of the mounting member 133, and the locking piece of each of the protruding blocks rests on the mounting member 133, such that the lampshade 60 is locked onto the bottom of the mounting member 133.

In the preferred embodiment of the present invention, the acoustics device 100 includes a sound module 30, and a diffuser 40 mounted on a bottom of the sound module 30. The diffuser 40 has a horn shape and has an opening directed toward an outside of the housing 11. The diffuser 40 diffuses the sound outward from the housing 11 to enhance the sounding effect.

In the preferred embodiment of the present invention, the wall seat 20 further includes a hanging bar 24 extending transversely from the connecting plate 22. The hanging bar 24 is provided with a mounting groove 25.

In the preferred embodiment of the present invention, the cover module 13 further includes a hand grip 134 mounted on the top cover 131. The hand grip 134 is mounted in the mounting groove 25 when the wall lamp 10 is placed on the wall seat 20 to secure the wall lamp 10 steadily.

In the preferred embodiment of the present invention, the protective covering 12 is provided with a through hole.

In the preferred embodiment of the present invention, the bottom of the housing 11 is provided with a recess which has a wall provided with an internal thread. The bottom of the protective covering 12 is provided with an external thread screwed into the internal thread of the housing 11.

In the preferred embodiment of the present invention, the wall washer 27 is electrically connected with the first quick charging terminal 26 and the second quick charging terminal 23.

In the preferred embodiment of the present invention, the first quick charging terminal 26 is electrically connected with the first connecting terminal 16, and the second quick charging terminal 23 is electrically connected with the second connecting terminal 15 when the wall lamp 10 is placed on the wall seat 20, so as to charge the charging battery 28 of the wall lamp 10.

In the preferred embodiment of the present invention, the wall lamp 10 further includes a circuit board mounted on the bottom of the housing 11 and electrically connected with the charging battery 28. The circuit board includes a detection module and a control chip electrically connected with the detection module. The detection module detects the charging state of the charging battery 28, and transmits the detected signal to the control chip. The control chip controls operation (turn on/off) of the primary lighting 50 and the secondary lighting 14. After the wall lamp 10 is removed from the wall seat 20, the detection module detects the charging battery 28 is not disposed at the charging state, such that the control chip turns on/off the secondary lighting 14.

Accordingly, when the wall lamp 10 is removed from the wall seat 20, the wall lamp 10 is used individually, thereby enhancing the versatility of the wall lamp assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A wall lamp assembly comprising:

a wall seat; and a wall lamp removably mounted on the wall seat;

wherein:

the wall lamp includes a housing, an acoustics device, a protective covering, a cover module, a primary lighting, a secondary lighting, and a charging battery;

the acoustic device is mounted in the housing and includes a sound module, and a diffuser is mounted on a bottom of the sound module;

the protective covering is mounted on the housing;

the cover module is mounted on the protective covering;

the primary lighting is mounted on a bottom of the cover module;

the secondary lighting is mounted on the housing and extends into the protective covering;

the charging battery is mounted in the housing;

the charging battery is electrically connected with the acoustics device, the primary lighting, and the secondary lighting;

the wall seat includes a wall washer, a drive power supply electrically connected with the wall washer, and a photosensitive device electrically connected with the wall washer; and the drive power supply of the wall seat is electrically connected with the charging battery of the wall lamp when the wall lamp is placed on the wall seat.

2. The wall lamp assembly of claim 1, wherein:

the wall lamp further includes a first connecting terminal mounted on a bottom of the housing, and a second connecting terminal mounted on a side of the cover module;

the first connecting terminal is electrically connected with the charging battery; and the second connecting terminal is electrically connected with the charging battery.

3. The wall lamp assembly of claim 1, wherein the wall seat has an L-shaped structure and includes a mounting plate, a connecting plate connected with the mounting plate, a first quick charging terminal mounted on the mounting plate, and a second quick charging terminal mounted on the connecting plate, and the wall washer is mounted on a bottom of the mounting plate.

4. The wall lamp assembly of claim 1, wherein:

the cover module includes a top cover mounted on and covering an open top of the protective covering, a link connected with the top cover, and a mounting member connected with the link;

the link connects the top cover and the mounting member, such that the mounting member is connected with the top cover through the link; and the mounting member is mounted in the protective covering.

5. The wall lamp assembly of claim 1, wherein:

the primary lighting includes a lighting body and a lampshade;

the lampshade is locked on a bottom of the mounting member; and the lighting body is located between the mounting member and the lampshade.

6. The wall lamp assembly of claim 5, wherein:

the bottom of the mounting member is provided with a plurality of locking holes;

the lampshade is provided with a plurality of protruding blocks extending upward;

each of the protruding blocks has a top provided with a locking piece extending downward slantingly;

the protruding blocks extend through the locking holes of the mounting member; and the locking piece of each of the protruding blocks rests on the mounting member.

7. The wall lamp assembly of claim 1, wherein: the diffuser has a horn shape and has an opening directed toward an outside of the housing.

8. The wall lamp assembly of claim 1, wherein:

the wall seat further includes a hanging bar extending transversely from the connecting plate; and the hanging bar is provided with a mounting groove.

9. The wall lamp assembly of claim 1, wherein the cover module further includes a hand grip mounted on the top cover.

* * * * *